US012742405B2

(12) United States Patent
Brück et al.

(10) Patent No.: US 12,742,405 B2
(45) Date of Patent: Sep. 22, 2026

(54) ELECTRICALLY HEATABLE HONEYCOMB STRUCTURE HAVING CORRUGATED LAYERS OF DIFFERENT CELL DENSITY

(71) Applicant: Vitesco Technologies GmbH, Regensburg (DE)

(72) Inventors: Rolf Brück, Bergisch Gladbach (DE); Peter Hirth, Rösrath (DE)

(73) Assignee: Vitesco Technologies GmbH, Regensburg (DE)

( * ) Notice: Subject to any disclaimer, the term of this patent is extended or adjusted under 35 U.S.C. 154(b) by 0 days.

(21) Appl. No.: 18/698,426

(22) PCT Filed: Sep. 22, 2022

(86) PCT No.: PCT/EP2022/076425
§ 371 (c)(1),
(2) Date: Apr. 4, 2024

(87) PCT Pub. No.: WO2023/057229
PCT Pub. Date: Apr. 13, 2023

(65) Prior Publication Data

US 2024/0410307 A1 Dec. 12, 2024

(30) Foreign Application Priority Data

Oct. 5, 2021 (DE) ..... 10 2021 211 213.7

(51) Int. Cl.
*F01N 3/28* (2006.01)
*F01N 3/20* (2006.01)

(52) U.S. Cl.
CPC ..... *F01N 3/2814* (2013.01); *F01N 3/2026* (2013.01); *F01N 3/281* (2013.01); *F01N 2240/16* (2013.01)

(58) Field of Classification Search
CPC ..... F01N 3/2814
See application file for complete search history.

(56) References Cited

U.S. PATENT DOCUMENTS 5,070,694 A 12/1991 Whittenberger
5,422,083 A * 6/1995 Sheller ..... B01J 35/56 422/177

(Continued)

FOREIGN PATENT DOCUMENTS

DE 102008033795 1/2010
DE 102016215289 2/2018

(Continued)

OTHER PUBLICATIONS

English language translation of JP H08-131840 A, generated with the J-PlatPat website (https://www.j-platpat.inpit.go.jp/) on Jun. 10, 2025.*

*Primary Examiner* — Humera N. Sheikh
*Assistant Examiner* — Julia L Rummel
(74) *Attorney, Agent, or Firm* — COZEN O'CONNOR

(57) ABSTRACT

A honeycomb body for an electrically heatable exhaust gas tract catalytic converter, having a plurality of flow channels through which flow occurs along a main through flow direction formed from a plurality of metal foils stacked on one another to form a layer stack, which is wound around at least one pivot point. The layer stack has at least one first metal foil having a first corrugation and a second metal foil having a second corrugation. The first and the second metal foils form first and second corrugated layers. The honeycomb body has a plurality of winding layers, which are spaced apart from one another in the radial direction in the wound state by an air gap. The first corrugation is different from the second corrugation and the layer stack has at least three corrugated layers. The corrugated layers are separated from one another by a third metal foil.

9 Claims, 1 Drawing Sheet

(56) References Cited

U.S. PATENT DOCUMENTS

| | | | | |
|---|---|---|---|---|
| 2011/0189055 | A1* | 8/2011 | Stuckey | B01J 35/56<br>422/310 |
| 2014/0322090 | A1* | 10/2014 | Brueck | F01N 3/2026<br>422/174 |
| 2015/0030509 | A1 | 1/2015 | Brueck et al. | |

FOREIGN PATENT DOCUMENTS

| | | | |
|---|---|---|---|
| EP | 0507216 | | 10/1992 |
| JP | H08131840 | | 5/1996 |
| JP | H08131840 | A * | 5/1996 |
| JP | H09173864 | | 7/1997 |
| JP | 2015504780 | | 2/2015 |
| JP | 2015520820 | | 7/2015 |

* cited by examiner

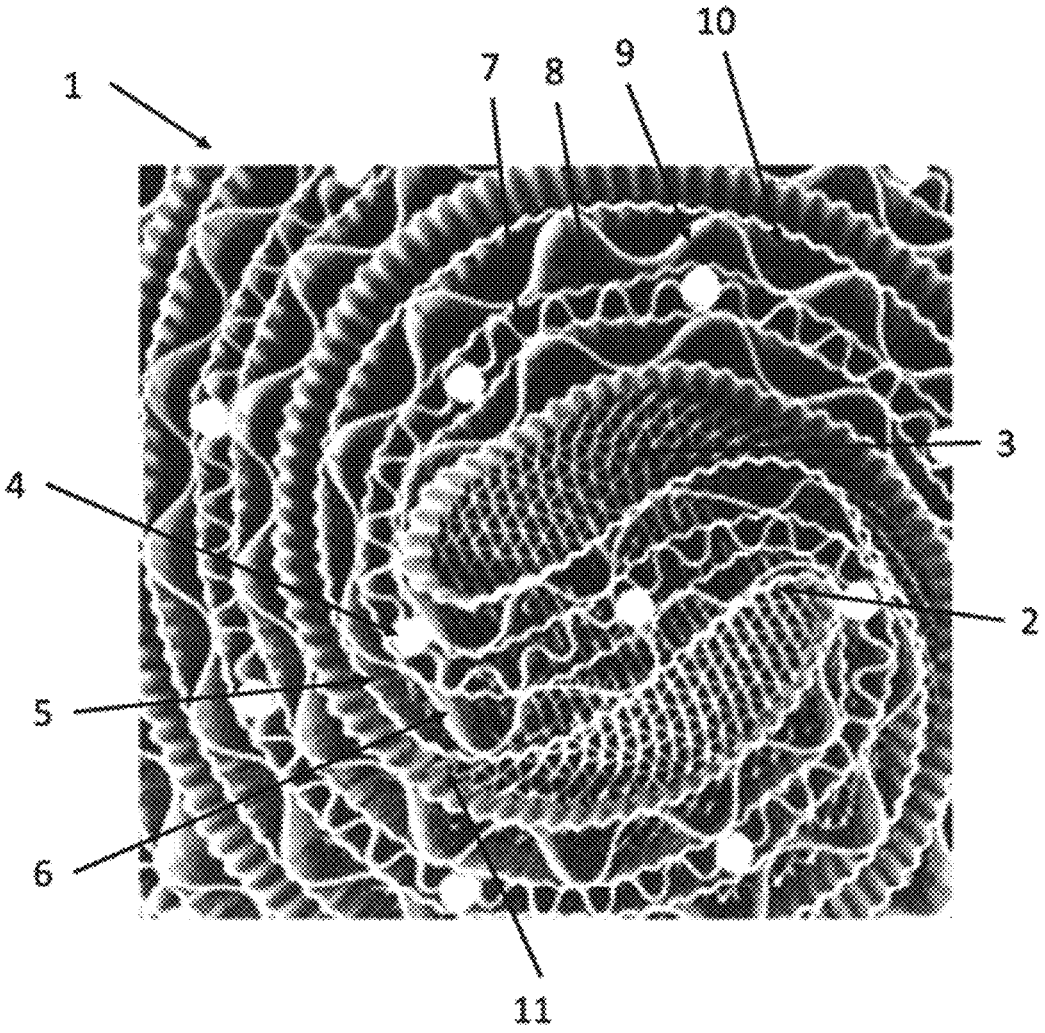
1
7
8
9
10
3
4
2
5
6
11

ELECTRICALLY HEATABLE HONEYCOMB STRUCTURE HAVING CORRUGATED LAYERS OF DIFFERENT CELL DENSITY

CROSS REFERENCE TO RELATED APPLICATIONS

This is a U.S. national stage of Application No. PCT/EP2022/076425 filed Sep. 22, 2022. Priority is claimed on German Application No. DE 10 2021 211 213.7 filed Oct. 5, 2021, the content of which is incorporated herein by reference.

BACKGROUND OF THE INVENTION

1. Field of the Invention

The disclosure relates to a honeycomb body for an electrically heatable catalytic converter in an exhaust gas tract, having a plurality of flow channels through which flow can occur along a main through flow direction, wherein the honeycomb body is formed from a plurality of metal foils stacked on one another to form a layer stack, which is wound around at least one pivot point, wherein the layer stack has at least one first metal foil which has a first corrugation and furthermore has at least one second metal foil which has a second corrugation, wherein the first metal foil and the second metal foil respectively form first and second corrugated layers, wherein the honeycomb body has a plurality of winding layers which are spaced apart from one another in the radial direction of the honeycomb body in the wound state by an air gap.

2. Description of the Related Art

Among other things, electrical heaters are used for heating exhaust gases of an internal combustion engine. These help to heat the exhaust gas temperature rapidly to a specified minimum temperature in order to be able to ensure the fastest and most complete possible exhaust gas posttreatment within an exhaust gas tract. The minimum temperature results from the so-called light-off temperatures of the catalytic converters used in the exhaust gas tract for the exhaust gas posttreatment. The catalytically active coating of the honeycomb bodies used requires such a minimum temperature to be able to have the process of chemical conversion run as completely as possible.

A known form for an electrical heater is a metallic honeycomb body which is connected to a voltage source. Heat is generated by the energizing of the honeycomb body utilizing the ohmic resistance. This is emitted to the flowing exhaust gas and partially also to the surrounding structures, due to which heating is achieved.

The metallic honeycomb bodies are formed from a plurality of different metallic foils. Smooth metal foils and metal foils which are partially or entirely structured are used for this purpose. A layer stack is created by stacking these metallic foils on one another. This layer stack is then wound by a suitable tool around so-called winding mandrels, by which a generally disk-shaped honeycomb body is formed, which forms a plurality of flow channels through which flow can occur along a main through flow direction.

The individual windings of the layer stack are spaced apart from one another by an air gap in the finished heating disk in order to prevent a short-circuit between different points of the heating disk and form a defined flow path along the length of the layer stack.

The flow cross section of the exhaust gas tract is occupied in the area of the heating disk of the electrical heater by the metal foils and the flow channels formed between them and the air gap between the windings. The metal foils and, due to their size, also the flow channels generate a counter-pressure which counteracts the exhaust gas flow. In electrical heaters having metallic honeycomb bodies which are known from the prior art, due to the comparatively high pressure loss as a result of the heating disk, exhaust gas preferably flows through the air gap. This is disadvantageous since no or only minor heating of the exhaust gas can take place there. The largest fraction of the amount of heat is transferred in the flow channels to the exhaust gas flowing past, since the electrical heater has the largest active surface there.

SUMMARY OF THE INVENTION

It is therefore the object of one aspect of the present invention to provide a honeycomb body for an electrical heater in an exhaust gas tract of an internal combustion engine, which has an improved through-flow profile and in particular ensures complete flow through the individual flow channels formed between the metal foils.

One exemplary aspect of the invention relates to a honeycomb body for an electrically heatable catalytic converter in an exhaust gas tract, having a plurality of flow channels through which flow can occur along a main through flow direction, wherein the honeycomb body is formed from a plurality of metal foils stacked on one another to form a layer stack, which is wound around at least one pivot point, wherein the layer stack has at least one first metal foil which has a first corrugation, and furthermore has at least one second metal foil which has a second corrugation, wherein the first metal foil and the second metal foil respectively form first and second corrugated layers, wherein the honeycomb body has a plurality of winding layers which are spaced apart from one another in the radial direction of the honeycomb body in the wound state by an air gap, wherein the first corrugation is different from the second corrugation and the layer stack has at least three corrugated layers, wherein the corrugated layers are each separated from one another by a smooth or microstructured third metal foil.

The production of the honeycomb body is performed by a known method, wherein the metal foils are stacked on one another and the layer stack thus created is wound around one or more winding mandrels. The layer stack creates multiple winding layers, which are arranged radially adjacent to one another and form the honeycomb body from the winding center to the outer radius of the honeycomb body. In case of an electrically heatable honeycomb body, as in the case according to the invention, the individual winding layers are spaced apart from one another in the radial direction by an air gap in order to prevent physical contact of the individual winding layers and thus in particular prevent an undesired current path. The goal is that a current flows through the honeycomb body from a defined current introduction point to a defined current discharge point.

The metal foils are essentially to be divided into two categories. Those having at least partial corrugation and those which are essentially smooth or only have very minor micro-structuring. The at least partially corrugated metal foils generally have an approximately sinusoidal corrugation. The corrugation is defined by the so-called pitch (p), which describes the distance on the X axis between two minima or maxima. In addition, the corrugation is defined by the wave width (w), which describes the distance on the Y axis between a minima and an adjacent maxima. The X axis of the corrugation extends in the direction of the height of the corrugation, while the Y axis extends in the direction of the width of the corrugation.

Cells are formed in the honeycomb body by the corrugation, through which flow can occur through the honeycomb body along its axial direction. The cells are delimited in the radial direction by the metal foils. The density of the cells per unit of area is specified in cells per square inch (cpsi). The higher this number, the more cells are arranged in a square inch. A high number of cells per square inch means a smaller cross section of the individual cells and thus an increased pressure loss.

The honeycomb body according to one aspect of the invention has at least two different corrugated layers, which are formed by the metal foils having the different corrugations. The different corrugated layers thus necessarily have different cell densities per unit of area. The different corrugated layers thus generate pressure losses of different amounts for a medium flowing through the cells, in particular an exhaust gas flow, for example.

With regard to the structural form essential to one aspect of the invention, which provides winding layers spaced apart from one another in the radial direction, at least three zones of different levels of pressure loss thus result over the cross section of the honeycomb body. On the one hand, the air gaps between the winding layers, which generate the least pressure loss. Furthermore, the corrugated layers having a low density of cells per unit of area and finally the area of the corrugated layers having a high density per unit of area. Due to the zones of different pressure loss, direct influencing of the exhaust gas flow takes place, by which improved flow through the electrically heated areas of the honeycomb body can be achieved and thus improved heating of the exhaust gas can be achieved.

It is particularly advantageous if the first metal foil has a lesser corrugation than the second metal foils.

The different corrugation has the result, as already described, of improved flow through the honeycomb body and thus improved heating of the exhaust gas. A lesser corrugation in particular means a corrugation which has a lesser wave height and/or a lesser wave width, by which a corrugated layer having a higher cell density per unit of area is achieved. The cell density of the corrugated layers is preferably to be in a range of 20 cpsi to 500 cpsi in order to ensure optimum flow through the cells.

The corrugated layers formed from the first metal foil preferably have, in the case of the corrugated layer made of the first metal foil, a cell density of 100 cpsi to 150 cpsi, or, in the case of the corrugated layer made of the second metal foil, a cell density of 25 cpsi and 85 cpsi. These cell densities are particularly advantageous in order to achieve advantageous cell densities for honeycomb bodies for heating exhaust gases of an internal combustion engine, which permit particularly uniform and complete flow through the cells of the honeycomb body.

The honeycomb body particularly advantageously has a porosity of 94% to 97%. Wherein the hydraulic diameter of the individual cells is preferably between 2 mm and 5 mm.

It is also advantageous if the corrugated layer which is formed from a first metal foil is used to accommodate support structures. The corrugated layer made of a first metal foil has the higher cell density and thus cells having a smaller hydraulic cross section. The corrugated layers are preferably designed to accommodate the support pins, by which the honeycomb body is supported in an electrically insulated manner in relation to another catalytic converter.

One preferred exemplary aspect is characterized in that the corrugated layer which is formed from a second metal foil is used to increase the rigidity of the honeycomb body. Corrugated layers having a higher rigidity can be created by the lower cell density. These corrugated layers are particularly suitable, when they form the edge layers of the layer stack, for creating a very dimensionally stable honeycomb body.

It is also preferred if the layer stack forming the honeycomb body has at least three corrugated layers, wherein at least one middle corrugated layer is formed by a first metal foil and at least the two corrugated layers forming the radial edges of the layer stack are each formed by a second metal foil.

The middle corrugated layer made of a first metal foil has the higher cell density in comparison and is used to accommodate the support structures, such as the support pins in particular. This corrugated layer preferably forms the central corrugated layer of the layer stack, while corrugated layers which are produced from second metal foils adjoin on both sides. These have a lower cell density, thus offer a lower resistance for the exhaust gas flowing through and are additionally more rigid, by which improved dimensional stability of the honeycomb body can be achieved.

Between the corrugated layers made of the first metal foil and the corrugated layers of the second metal foil, smooth layers or so-called microstructured layers are preferably arranged, which separate the corrugated layers from one another and in particular prevent the adjacent corrugated layers from slipping into one another.

In addition, it is advantageous if the layer stack forming the honeycomb body has precisely three corrugated layers, wherein in succession a third metal foil, a second metal foil, a third metal foil, a first metal foil, a third metal foil, a second metal foil, and a third metal foil are arranged inside the layer stack. The central corrugated layer made of the first metal foil forms the receptacle for the support pins. The two laterally adjoining corrugated layers made of the second metal foils increase the stability and at the same time reduce the pressure loss arising at the edge area, due to which in particular the flow through the air gap formed between the winding layers is avoided or significantly reduced.

Overall, the construction of the layer stack from three corrugated layers is optimal, on the one hand, to achieve the highest possible effectiveness for heating the exhaust gas and, on the other hand, to keep the costs and the production effort as low as possible. In addition, it is particularly advantageous with the typical dimension relationships of the honeycomb body for heating exhaust gas in the exhaust gas tract of a passenger vehicle or a truck to select a three-layered structure. The required ohmic resistance may thus be set particularly well, in order to achieve sufficiently rapid and strong heating of the exhaust gas using the available electric currents.

Furthermore, it is advantageous if the second metal foils each form a corrugated layer which has a corrugation having greater wave height and/or greater wave width than the at least one corrugated layer formed by a first metal foil.

The variation of the wave height can contribute to a reduction of the cell density per unit of area. This can also be achieved via the variation of the wave width. The edge layers preferably have a lower cell density per unit of area in comparison to the central layers, by which the flow through the cells of the honeycomb body is deliberately improved and the exhaust gas flowing past through the air gaps formed is reduced or prevented.

It is also expedient if the corrugated layers forming the radial edge area of the layer stack generate a lower pressure loss for a fluid flowing through than the corrugated layers arranged in the center of the layer stack.

In addition, it is advantageous if the cell density of the corrugated layers formed by the first metal foils is between 100 cpsi (cells per square inch) and 150 cpsi and the cell density of the corrugated layers formed by the second metal foils is between 25 cpsi and 80 cpsi. This ratio of the cell densities forms a preferred optimum, in particular for passenger vehicle and truck applications, for the normal structural sizes, the flow speeds, the temperatures, and the electric currents available for heating.

Furthermore, it is expedient if at least one first group of the second metal foils is provided which has a ratio (p/W) of wave height (p) to wave width (W) of less than 1.8 and/or at least one second group of the second metal foils is provided, which has a ratio (p/W) of wave height (p) to wave width (W) of greater than 1.8.

The ratio p/W is an essential factor for the design of the respective corrugated layer here. The greater the ratio is, the flatter the wave becomes, by which the layer becomes more flexible in particular in the Y direction, thus in the direction transverse to the corrugation, due to which the corrugated layer is easier to wind up, but is also more susceptible at the same time to undesired deformations and damage.

A very low ratio of p/W results in a tall corrugation, by which the flexibility in the Y direction is reduced and a higher rigidity of the corrugated layer is achieved.

It has been shown by extensive studies that the inflection point with respect to the stability of the corrugated layer is in the range around the number 1.8 for the ratio of p/W. For a ratio below 1.8, the corrugated layer tends to be rigid for this purpose, which is good with respect to the stability, since the corrugated layer cannot be mechanically deformed as easily, by which cells could be damaged or closed. For ratios above 1.8, the corrugated layer tends to be soft for this purpose, which is advantageous to absorb radial forces and tensions, and thus to ensure the durability of the corrugated layer or the honeycomb body.

Advantageous developments of the present invention are described in the dependent claims and in the following description of the FIGURES.

BRIEF DESCRIPTION OF THE DRAWINGS

The invention will be discussed in detail below on the basis of an exemplary embodiment and with reference to the drawing. In the drawing:

The FIG. 1 is a view of a honeycomb body, wherein the flow channels formed by the honeycomb body extend along a surface normal to the plane of the drawing.

DETAILED DESCRIPTION OF THE PRESENTLY PREFERRED EMBODIMENTS

The FIGURE shows a top view of a honeycomb body 1, which is formed from a layer stack 2 by winding. The layer stack 2 is supported by support pins 4 in relation to a catalytic converter 3 arranged behind it. The layer stack 2 is wound around two winding mandrels, due to which the layer stack 2 has an S-shaped course. The individual winding layers are spaced apart from one another in the radial direction by the air gap 11.

The layer stack 2 has a central corrugated layer which is formed from a first metal foil 7. This corrugated layer is enclosed by third metal foils 5, 10, which have a micro-structuring. Alternatively, a completely smooth third metal foil could also be provided.

The third metal foils 5, 10 are adjoined by two corrugated layers made of second metal foils 6, 9. The second metal foils 6, 9 have a somewhat greater wave height (pitch) and a substantially greater wave width, due to which the corrugated layers formed by the second metal foils 6, 9 have a lower cell density than the corrugated layer formed by the first metal foil 5, 10.

The second metal foils 6, 9 are each in turn adjoined by third metal foils 5, 10, which also have a micro-structuring and in alternative designs could also be formed by completely smooth metal foils.

The air gap 11 is used for electrically isolating the individual winding layers from one another and thus preventing short-circuits and undesired current conduction paths.

The exemplary embodiment in the FIGURE is in particular not of a limiting nature, and serves for illustrating the concept of one aspect of the invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A honeycomb body for an electrically heatable catalytic converter in an exhaust gas tract, having a plurality of flow channels through which flow can occur along a main through flow direction, comprising:

a plurality of separate metal foils stacked on one another to form a layer stack, which is wound around at least one pivot point, the layer stack, when wound, forms a plurality of winding layers, wherein the layer stack has:

a first corrugated layer having at least one first metal foil which has a first corrugation defined by a first cell density per unit of area, a second corrugated layer having at least one second metal foil which has a second corrugation defined by a second cell density per unit of area, wherein the honeycomb body has the plurality of winding layers, which are spaced apart from one another in a radial direction of the honeycomb body in a wound state by an air gap that electrically isolates the individual winding layers from one another, wherein the first cell density per unit of area of the first corrugation is different from the second cell density per unit of area the second corrugation such that the first cell density per unit area of the first corrugation is between 100 cpsi (cells per square inch) and 150 cpsi and the second cell density per unit area of the second corrugation is between 25 cpsi and 80 cpsi, wherein the layer stack has at least three corrugated layers, and wherein respective corrugated layers are each separated from one another by a smooth or microstructured third metal foil.

2. The honeycomb body as claimed in claim 1, wherein the at least one first metal foil has a lesser corrugation than the at least one second metal foil.

3. The honeycomb body as claimed in claim 1, wherein the honeycomb body further comprises support structures and the first corrugated layer accommodates the support structures.

4. The honeycomb body as claimed in claim 1, wherein the corrugated layer which is formed from a second metal foil is configured to increase a rigidity of the honeycomb body.

5. The honeycomb body as claimed in claim 1, wherein the layer stack forming the honeycomb body has at least three corrugated layers, wherein at least one middle corrugated layer is formed by a first metal foil and at least the two corrugated layers forming an upper and a lower layer of the layer stack are each formed by a second metal foil.

6. The honeycomb body as claimed in claim 1, wherein the layer stack forming the honeycomb body has precisely the three corrugated layers, wherein in succession a third metal foil, a second metal foil, a third metal foil, a first metal foil, a third metal foil, a second metal foil, and a third metal foil are arranged inside the layer stack.

7. The honeycomb body as claimed in claim 1, wherein each of the at least one second metal foils form a corrugated layer, which has a corrugation having greater wave height and/or greater wave width than the at least one corrugated layer formed by a first metal foil.

8. The honeycomb body as claimed in claim 5, wherein the corrugated layers forming a radial edge area of the layer stack when wound generate a lower pressure loss for a fluid flowing through than the corrugated layers arranged in a center of the layer stack.

9. The honeycomb body as claimed in claim 1, wherein at least one first group of the second metal foils is provided which has a ratio of wave height to wave width of less than 1.8 and/or at least one second group of the second metal foils is provided which has a ratio of wave height to wave width of greater than 1.8.

* * * * *